US007621279B1

(12) United States Patent
Anagnostou

(10) Patent No.: US 7,621,279 B1
(45) Date of Patent: Nov. 24, 2009

(54) HAIR LIFT DEVICE

(76) Inventor: Zena Marie Anagnostou, 8918 Van Moore La., Orangevale, CA (US) 95662

( * ) Notice: Subject to any disclaimer, the term of this patent is extended or adjusted under 35 U.S.C. 154(b) by 0 days.

(21) Appl. No.: 11/127,596

(22) Filed: May 10, 2005

(51) Int. Cl.
*A45D 24/38* (2006.01)
*A45D 8/00* (2006.01)

(52) U.S. Cl. ..... 132/144; 132/273

(58) Field of Classification Search ..... 132/273–278, 132/144, 146, 148, 219, 153; D28/33, 22; 24/712
See application file for complete search history.

(56) References Cited

U.S. PATENT DOCUMENTS 879,126 A * 2/1908 Angus ..... 132/105
1,146,934 A * 7/1915 Gleeson ..... 132/273
2,902,042 A * 9/1959 Halber ..... 132/133
6,026,548 A * 2/2000 Jackson ..... 24/712
6,047,705 A * 4/2000 Hawley ..... 132/128
6,164,291 A * 12/2000 Filippone ..... 132/273
6,484,729 B1 * 11/2002 Silva ..... 132/200
6,601,589 B2 * 8/2003 Ericks ..... 132/273

* cited by examiner

*Primary Examiner*—Robyn Doan
(74) *Attorney, Agent, or Firm*—Ingrid McTaggart

(57) ABSTRACT

One embodiment of an hair lift device includes an elongate flexible member and a locking mechanism that adjustably secures the elongate flexible member in position to allow a wearer to adjust a position of their hair.

18 Claims, 4 Drawing Sheets

HAIR LIFT DEVICE

BACKGROUND OF THE INVENTION

This invention pertains to clothing accessories. The invention combines hair combs accessories with a hair scrunchie, and a release button, so that one's hair can be lifted or lowered at the wearer's option.

BRIEF SUMMARY OF THE INVENTION

Prior to this invention people with long hair had a choice between having their hair permanently "up" (off their shoulders) only by use of a bandana, scrunchie, rubber bands, barrette, hair ties or other device. To take one's hair down requires the removal of the hair accessory. The invention allows one's hair to be up (off the shoulders) at the simple pull of a elongate flexible member, and down at the push of a button. The decorative hair comb would not have to be removed while the wearer enjoys either option.

DETAILED DESCRIPTION OF THE INVENTION

Figure 1:
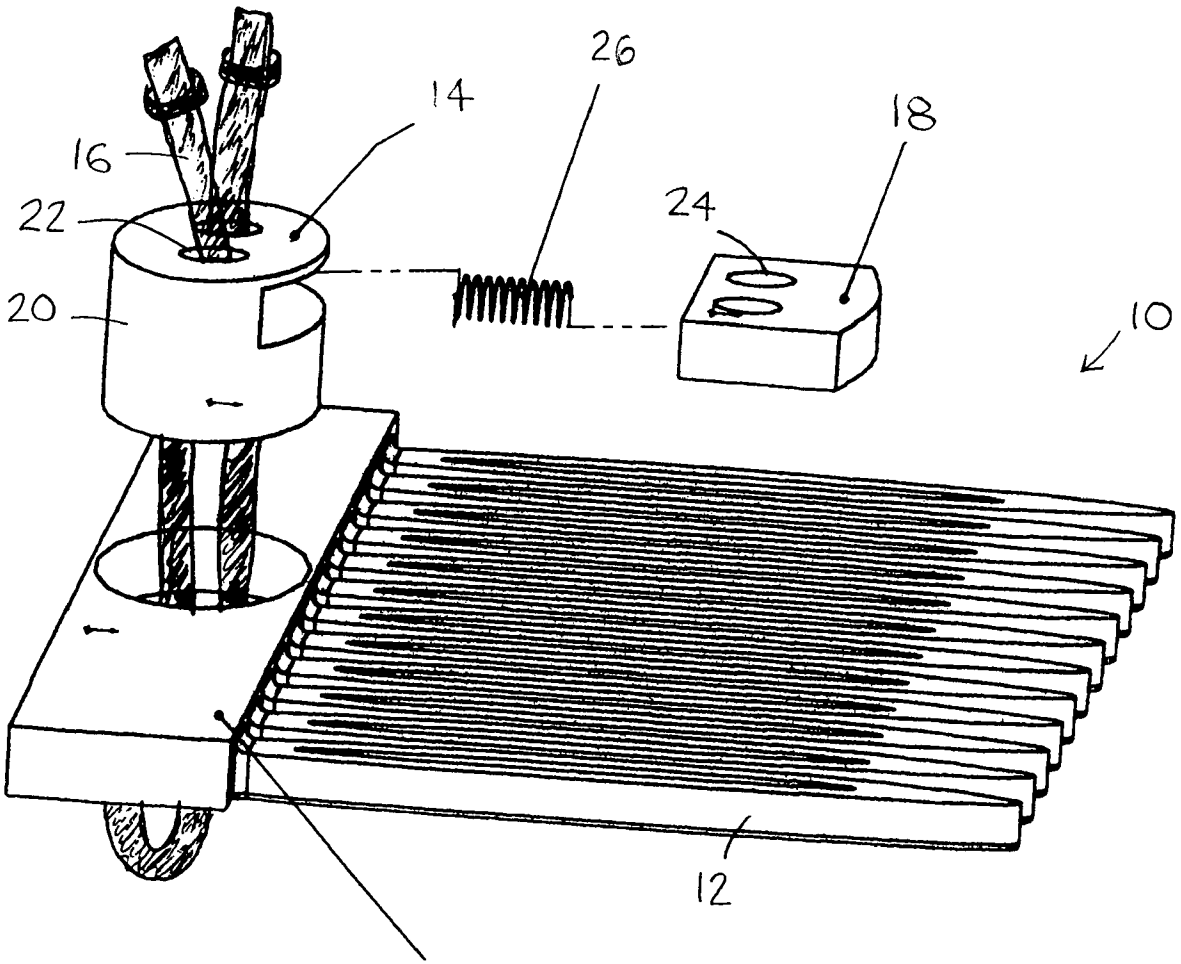
FIG. 1 shows the invention in an exploded perspective view, wherein only a portion of the elongate flexible member is shown.

Referring to FIG. 1, this invention is an improvement over all previous existing methods of hair control. This invention 10 combines a decorative hair comb 12 with a gripper or locking mechanism 14 allowing the wearer to pull their hair up or release it down at the wearer's option. The invention works by use of a elongate flexible member 16 positioned through a locking mechanism 14. Once the comb 12 is in place the wearer pulls on the elongate flexible member 16 to lift their hair up off their shoulder. Then the wearer can push the release button or insert 18 (into base 20 of locking mechanism 14) allowing the elongate flexible member 16 to move freely (within aligned holes 22 of base 20 and holes 24 of insert 18) and wear their hair down or any point in between. This invention 10 will be made of plastic with the exception of the elongate flexible member 16 and the biasing member 26 of the locking mechanism 14. The elongate flexible member 16 will be made of various materials, such as nylon, cotton, silk or other materials. The biasing member 26 of the locking mechanism 14 will be made of metal.

Figure 2B:
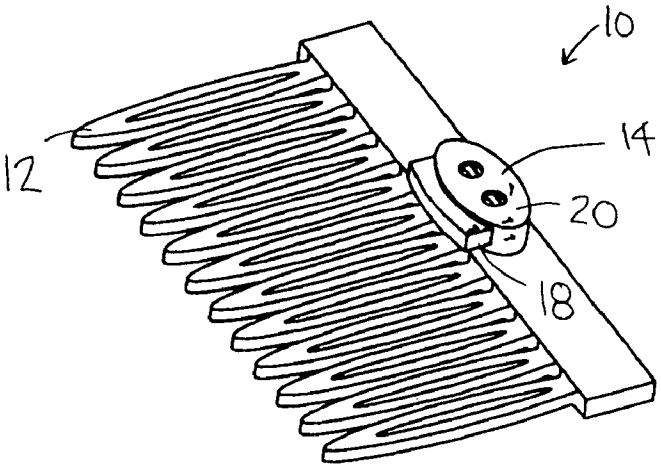
FIGS. 2A-2C show a front view of one embodiment, a perspective view of one embodiment, and a top view of another embodiment of the invention having an arc shape to conform to a wearer's head, respectively, without the elongate flexible member being shown.
Figure 2A:
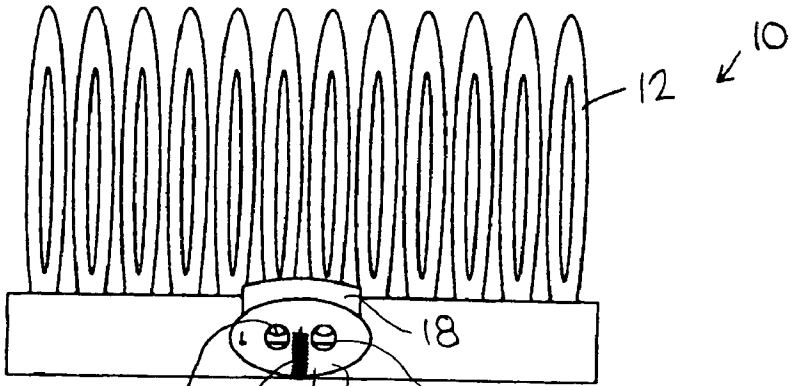

FIGS. 2A and 2B show insert 18 biased outwardly of base 20 of locking mechanism 14 such that holes 22 of base 20 and holes 24 of insert 18 are not completely aligned, thereby facilitating frictional securement of elongate flexible member 16 (see FIG. 1) in place. The position of biasing member 26 is shown within locking mechanism 14 though the biasing member generally would be hidden from view.

Figure 2C:
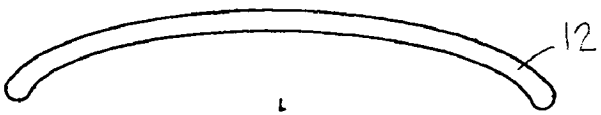

FIG. 2C shows a top view of another embodiment wherein comb 12 defines an arced shape that may conform to the shape of a wearer's head.

Figure 3A:
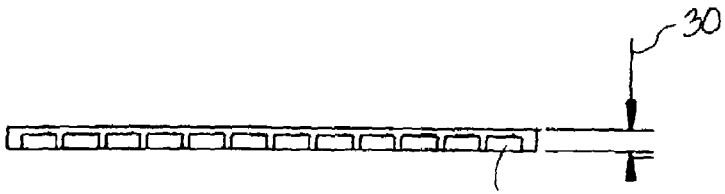
FIGS. 3A-3C show a bottom view, a front view, and a side view of the invention, respectively, without the elongate flexible member being shown.
Figure 3B:
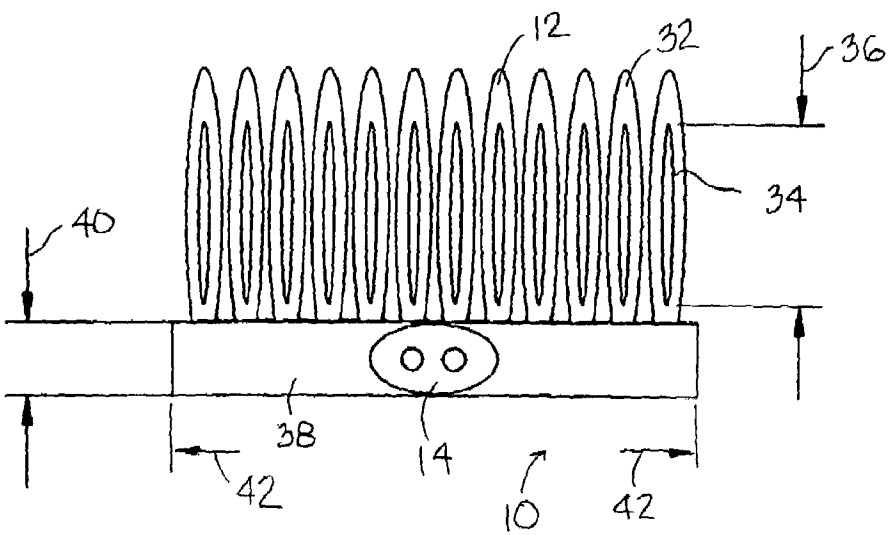
Figure 3C:
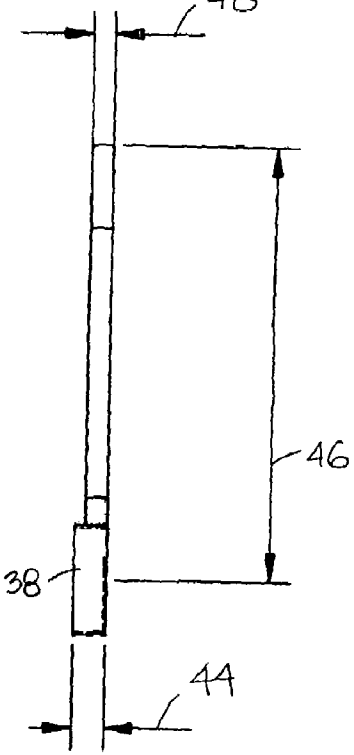

FIG. 3A shows a bottom view of comb 12. Comb 12 has a thickness 30 of 3 millimeters (mm). FIG. 3B shows a front view of the inventive hairpiece 10. Teeth 32 of comb 12 have aperture 34 with a length 36 of 25 mm. Comb 12 has an end region 38 having a width 40 of 10 mm and a length 42 of 75 mm. FIG. 3C shows a side view of the invention. End region 38 of comb 12 has a thickness 44 of 3 mm. Comb 12 has a length 46 of 44 mm and a thickness 48 of 2 mm.

Figure 4A:
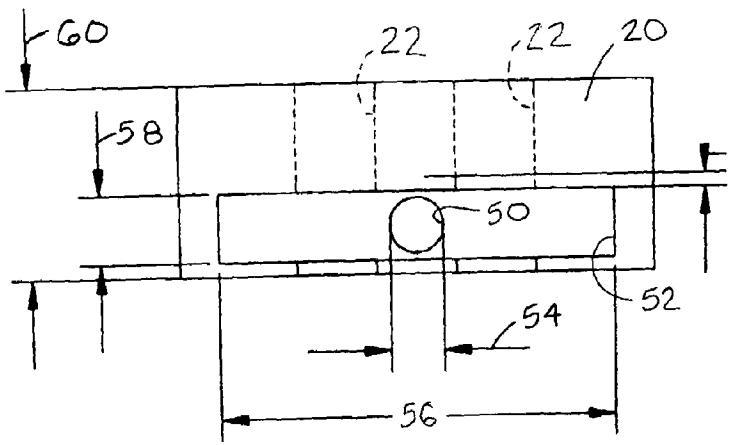
FIGS. 4A-4D show a side view and a top view of a locking mechanism base, and a side view and top view of a locking mechanism insert, respectively, of one embodiment of the invention, wherein a biasing member inserted in the insert will lock an elongate flexible member between the base and the insert, and wherein the elongate flexible member is released by pressing on the insert and lining up the holes between the base and the insert, thereby allowing the elongate flexible member to move freely.
Figure 4B:
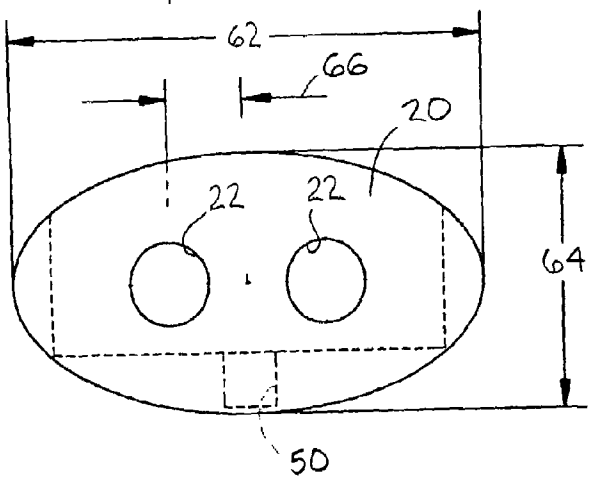

FIGS. 4A and 4B show a side view and a top view, respectively, of locking mechanism base 20. Referring to FIG. 4A, base 20 includes an aperture 50 for receiving biasing member 26 and another aperture 52 for receiving insert 18 (see FIGS. 4C and 4D). Aperture 50 has a diameter 54 of 2 mm and aperture 52 has a length 56 of 15 mm and a width 58 of 2.5 mm. Base 20 has a height 60 of 7 mm. Referring to FIG. 4B, base 20 has a length 62 of 18 mm and a width 64 of 9.5 mm. Holes 22 are each off centered from a center point of base 20 by a distance 66 of 3 mm.

Figure 4C:
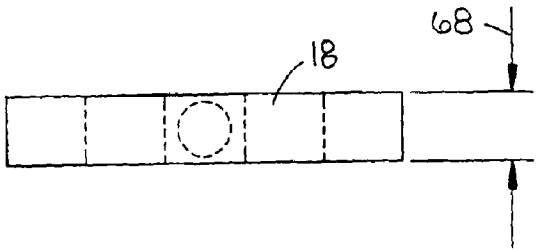
Figure 4D:
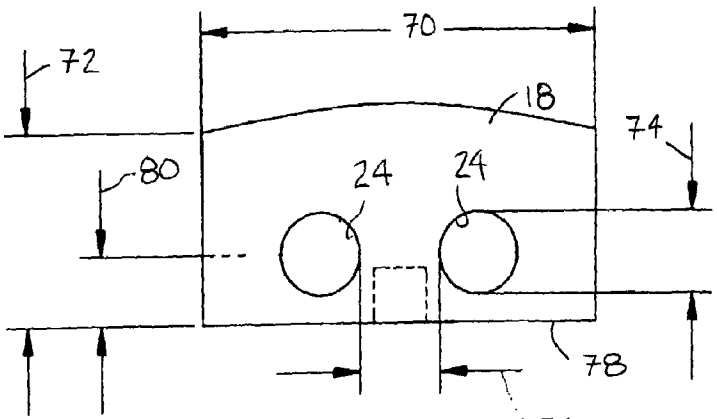

FIGS. 4C and 4D show a side view and top view of locking mechanism insert 18, respectively, of one embodiment of the invention. Referring to FIG. 4C, insert 18 has a height 68 of 2.5 mm. Referring to FIG. 4D, insert 18 has a length 70 of 15 mm and a width 72 of 7 mm. Holes 24 of insert 18 have a diameter 74 of 3 mm and are spaced apart a distance 76 of 3 mm. Holes 24 of insert 18 are spaced from rear surface 78 a distance 80 of 2.5 mm.

The invention claimed is:

1. A hair lift device, comprising:

a base structured for securement to hair independently of an elongate flexible member, said base including a hair comb with a plurality of teeth and a first aperture;

a locking device including biasing structure that biases said locking device to move from an unlocked position to a locked position on said base, said locking device including a second aperture aligned with said first aperture when said locking device is in said unlocked position and non-aligned with said first aperture when said locking device is in said locked position; and an elongate flexible member having a first section secured to said base and a second section adjustably positioned through said first aperture of said base and said second aperture of said locking device wherein a length of said elongate flexible member extending between said first section and said second section forms a loop on said base configured to receive a lock of hair within said loop and to secure said lock of hair to said base.

2. The device of claim 1 wherein said flexible member is movable within said first and second apertures when said locking device is in said unlocked position and is immovable within said first and second apertures when said locking device is in said locked position.

3. The device of claim 1 wherein said biasing structure comprises a spring.

4. The device of claim 1 wherein said base includes first and third apertures, said locking device includes second and fourth apertures, wherein said first and second apertures are aligned in said unlocked position, said third and fourth apertures are aligned in said unlocked position, and wherein said flexible member extends through said first and second apertures and through said third and fourth apertures.

5. The device of claim 1 wherein said locking device is secured on said base by said flexible member.

6. The device of claim 1 wherein said flexible member is a cord manufactured from a material chosen from the group consisting of nylon, cotton, leather, and silk.

7. The device of claim 1 wherein said first section is adjustably secured to said base through a third aperture of said base and a fourth aperture of said locking device, wherein said length of said elongate flexible member extending between said first section and said second section forms said loop on said base configured to receive a lock of hair within said loop and to secure said lock of hair to said base.

8. A hair securement device, comprising:

a hair attachment device in a form of a hair comb including an aperture extending therethrough and a plurality of teeth;

a cord securement device biased to move from a release position to a secure position on said hair attachment device, said cord securement device including an aperture aligned with said aperture of said hair attachment device when said cord securement device is in said release position and non-aligned with said aperture of said hair attachment device when said cord securement device is in said secure position; and a cord extending through said aperture of said hair attachment device and said aperture of said cord securement device to form a loop adjustably secured on said hair attachment device.

9. The device of claim 8 wherein said cord is immovable through said hair attachment device when said cord securement device is in said secure position.

10. The device of claim 8 wherein said cord is movable through said hair attachment device when said cord securement device is in said release position.

11. The device of claim 8 wherein said hair attachment device includes a pair of apertures aligned with a pair of apertures of said cord securement device when said cord securement device is in said release position.

12. The device of claim 11 wherein said cord defines said loop adapted for receiving hair therethrough, and wherein a size of said loop is adjusted by movement of said cord through said apertures of said hair attachment device and said cord securement device.

13. The device of claim 8 wherein said cord has a cross sectional area substantially the same size as a cross sectional area of said aperture of said hair attachment device and said aperture of said cord securement device.

14. A method of using a hair securement device, comprising:

moving a release structure on a hair securement device to a release position, said hair securement device being a hair comb including a plurality of teeth;

adjusting a position of a cord through an aperture in said release structure and through an aperture in said hair securement device to form a loop of cord adjustably secured on said hair securement device;

placing a lock of hair though said loop of cord;

releasing said release structure on said hair securement device such that said release structure is biased into a lock position on said hair securement device to lock said cord against movement on said hair securement device and so as to secure said lock of hair within said loop; and placing said hair securement members within hair of the wearer such that said hair securement device is secured in place.

15. The method of claim 14 wherein said adjusting a position of said cord comprises adjusting a size of said loop of said cord extending outwardly from said hair securement device.

16. The method of claim 14 wherein said moving a release structure comprises moving said release structure into a gripping device to align a pair of apertures in said gripping device with a pair of apertures in said release structure.

17. The method of claim 14 wherein said hair securement device comprises a comb including a plurality of teeth.

18. The method of claim 14 wherein said hair securement device is secured in place to position said loop of cord at a desired position on the wearer's head.

* * * * *